US005881746A

United States Patent [19]

Buser et al.

[11] Patent Number: 5,881,746

[45] Date of Patent: Mar. 16, 1999

[54] METHOD AND DEVICE FOR DRYING CROCKERY IN A DISHWASHER

[75] Inventors: Josef Buser, Schönenberg/Kubelberg; Ingrid John, Saarbrücken; Christa Maurer, Ottweiler; Ralf Wilhelmstatter, Gengen/Brenz; Peter Schwarzweller, St. Wendel, all of Germany

[73] Assignee: Whirlpool Europe B.V., Veldhoven, Netherlands

[21] Appl. No.: 547,478

[22] Filed: Oct. 24, 1995

[30] Foreign Application Priority Data

Oct. 25, 1994 [DE] Germany ..... 44 38 086.0
Dec. 9, 1994 [DE] Germany ..... 44 43 849.4

[51] Int. Cl.[6] ..... B08B 3/00

[52] U.S. Cl. ..... 134/58 D; 134/58 DL; 134/57 D; 34/76; 34/87

[58] Field of Search ..... 34/76, 87, 469, 34/474; 134/56 D, 57 D, 58 D, 58 DL

[56] References Cited

U.S. PATENT DOCUMENTS

| | | | |
|---|---|---|---|
| 3,798,465 | 3/1974 | Guth | 307/141 |
| 3,985,023 | 10/1976 | Guth | 70/267 |
| 4,951,693 | 8/1990 | Archambault | 134/57 |

FOREIGN PATENT DOCUMENTS

| | | | |
|---|---|---|---|
| 2 256 129 | 9/1987 | European Pat. Off. | A47L 15/48 |
| 0 374 616 A1 | 5/1990 | European Pat. Off. | A47L 15/48 |
| 0 374 616 | 6/1990 | European Pat. Off. | A47L 15/48 |
| 0 486 828 A1 | 5/1992 | European Pat. Off. | A47L 15/48 |
| OS 19 26 049 | 11/1970 | Germany . | |
| 33 45 604 A1 | 7/1985 | Germany | A47L 15/42 |
| 39 22 754 | 1/1991 | Germany | A47L 15/42 |
| 39 22 754 A1 | 1/1991 | Germany | A47L 15/42 |
| 39 41 226 A1 | 6/1991 | Germany | A47L 15/48 |
| 923517 | 4/1985 | U.S.S.R. | A47L 15/00 |

*Primary Examiner*—Henry A. Bennett
*Assistant Examiner*—Dinnatia Doster
*Attorney, Agent, or Firm*—Mark A. Davis; Thomas J. Roth

[57] ABSTRACT

The invention relates to a method and to a device for carrying out the method for drying crockery in a dishwasher with a rinse container closeable by means of a door. By means of two or three successive different method steps, the drying is improved. The method steps include a drainage phase, a drying phase with blower or condenser and an automatic, partial opening of the door.

13 Claims, 3 Drawing Sheets

METHOD AND DEVICE FOR DRYING CROCKERY IN A DISHWASHER

BACKGROUND OF THE INVENTION

1. Field of the Invention

The invention relates to a method for drying crockery in a dishwasher with a rinse container closeable by means of a door.

2. Description of the Related Art

A plurality of methods for drying crockery in a dishwasher are known, in which however the drying effect is often insufficient, or in which other disadvantages must be accepted.

Thus DE-OS 19 26 049 describes a method in which, during drying, the vapour is removed from the rinse container. In this case the vapour is evacuated with air from the rinse container, precipitated in a condenser, and the air freed of vapour is returned to the rinse chamber. A blower may also however be provided, which evacuates the air and the vapour from the rinse container. In the former case the vapour is not entirely precipitated in the condenser, and in the latter case, evacuation must be effected over an extremely low period, in order to keep the level of residual moisture in the rinse container low.

As DE 33 45 604 A1 shows, it is also known to open the door to form a slot after a predetermined time in a dishwasher, in order to improve the drying procedure by escape of the residual moisture.

It is known from DE 34 18 304 A1, to mix the evacuated moist air from the rinse chamber with fresh air. By means of a blower with two rotor wheels, a ratio of air mixture is achieved, so that in the air mixture emerging into the room, the conditions do not come below the dewpoint. An improvement in the drying effect is thus achieved by special constructive design, as shown by DE 42 21 182 A1.

Another design of the fresh air channel and of the ventilation opening in a dishwasher is shown in EP 0 374 616 B1, a flow divider chamber with a control valve being provided, in order to reduce the outlay on removal of vapour.

SUMMARY OF THE INVENTION

The purpose of the invention, in a method of the type already mentioned, is to improve the drying procedure with simple means, without rendering the dishwasher more difficult to use.

This purpose is fulfilled according to the invention in a dishwasher, in that, after the cleaning and clear rinsing cycles, within a predetermined time moist air in the rinse container is replaced by dry fresh air, and in that thereafter the door is automatically opened to form a slot, and the remaining residual moisture escapes by natural convection.

An improvement in drying is also achieved in that, after the cleaning and clear rinsing cycles, a predetermined drainage time is introduced, and in that, after the drainage time, for a predetermined period moist air in the rinse container is replaced by dry fresh air.

In each case, the drying procedure is improved by the two process steps, the automatic opening of the door to form a slot requiring no further operating measures. The point in time for this opening of the door is in this case so selected that the remaining moist and warm air constitutes no risk to the person operating the machine, and has no negative effect on any work surface located above the door. This air can therefore flow freely into the kitchen area.

The drainage time after the cleaning and clear rinsing cycles improves the drying in that during this standstill phase residual water can drain unhindered from the crockery, as it is still under reduced surface tension from the preceding clear rinsing cycle. This portion thus no longer requires to be removed by dry fresh air from the rinse container.

Removal of moist air from the rinse container may be effected in that the moist air is evacuated from the rinse container by means of a blower, or in that water is precipitated from the moist air in a condenser, introduced into the rinse container and then removed from the rinse container by an evacuating pump.

The slot formed during the automatic partial opening of the door is selected to be approximately 10 mm. In the case of a bottom-hinged door, this is in the region of the free upper edge. Dry fresh air is supplied to the rinse container for a period of approximately 10 minutes.

The drainage time is selected to be between 2 and 5 minutes. The device for carrying out the method is initially characterised in that, in order to provide partial opening of the door, a movably mounted closure bracket is provided, which is displaceable by means of a motor with a reduction gear and which, when the lock is engaged, holds the door securely. In this design of the device, the lock must still be actuated in order to open the door completely.

If on the other hand the design is such that, for partial opening of the door, a movably mounted closure bracket is provided, which is displaceable by means of a motor with a reduction gear, and releases the lock, and in that the door is held in the open position by means of a counterbalance device, then the door may simply be swung down from the slot-like open position.

The times fixed for the method steps are derived from the control system of the dishwasher.

BRIEF DESCRIPTION OF THE DRAWINGS

The invention will now be explained in more detail with reference to embodiments given by way of example and illustrated in the drawings, which show.

DESCRIPTION OF THE PREFERRED EMBODIMENT

Figure 1:
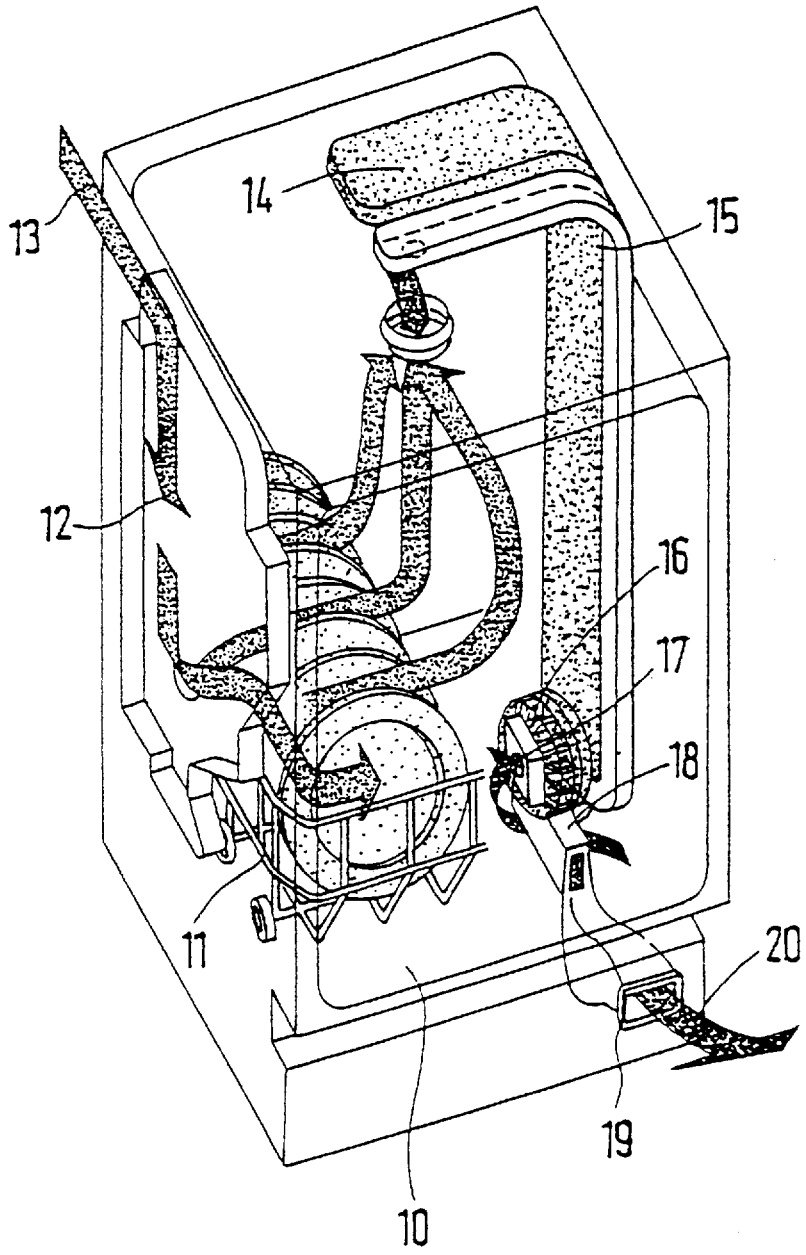
FIG. 1: a perspective constructive diagram of a dishwasher with blower.

As the diagram in FIG. 1 shows, a crockery basket 11 filled with crockery 21 is housed in the rinse container 10. A blower 16 located beneath the rinse container 10 introduces dry fresh air 13 through an inlet opening 12 in one side of the dishwasher casing, said fresh air passing over the crockery 21 and through a duct 14 to the blower 16. The moist air is likewise evacuated from the rinse container 10 through the duct 14 and mixed with the introduced fresh air, which is now charged with moisture. The air mixture passes over the outlet 18 of blower 16 and a duct to the outlet opening 19. The air mixture 20 passes though the outlet opening 19, which is preferably located on the front side of the dishwasher.

Figure 2:
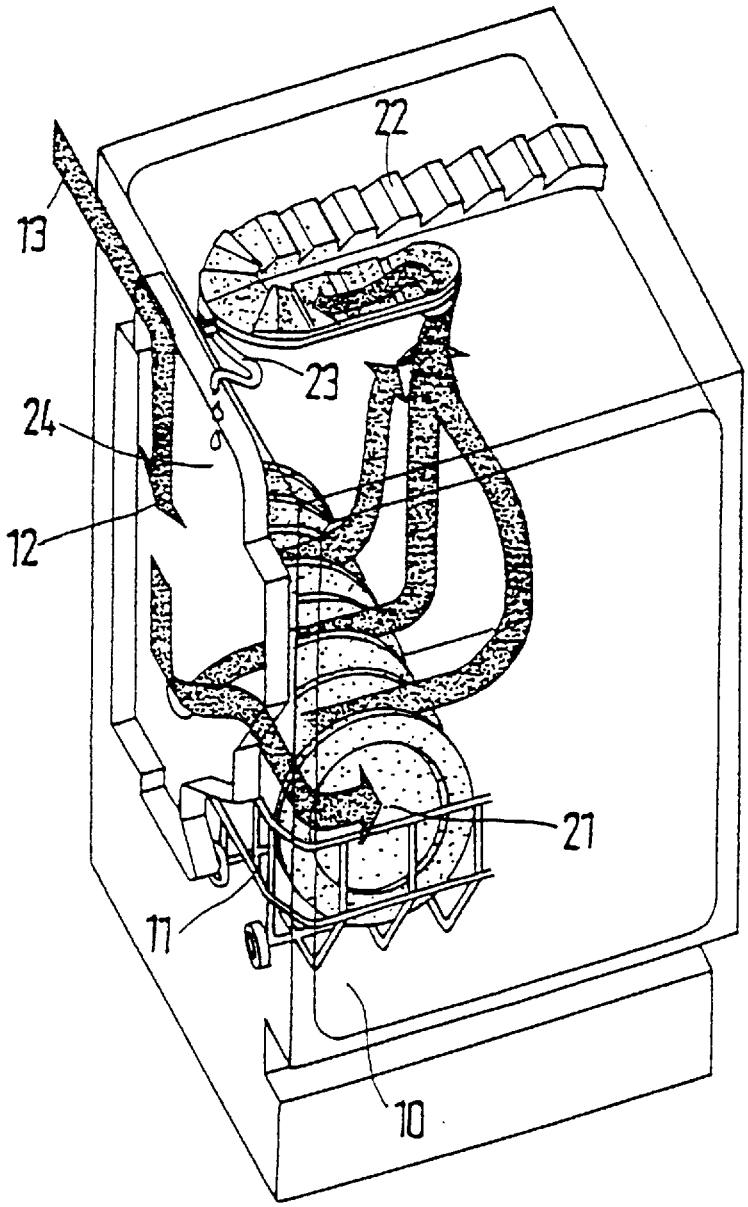
FIG. 2: a perspective constructive diagram of a dishwasher with condenser.

If the dishwasher has a condenser 22 in the rinse container 10, then the dry fresh air 13 flows through the inlet opening 12 into the rinse container 10 and passes the air charged with moisture about the crockery 21 in the crockery basket 11 out of the rinse chamber, as FIG. 2 shows. In the condenser 22 water is precipitated from the air thus mixed, and passed through a hosepipe 23 into the rinse container 10.

The method may be carried out in both types of dishwasher in such a way that a drying phase with the blower or the condenser is followed by a predetermined period during which the door is automatically opened to form a slot. This partial opening of the door however may be omitted if a drainage phase during a predetermined period precedes the drying phase.

Finally, the drying procedure may be improved if a drainage phase during a predetermined time is followed by a drying procedure for a predetermined time with the blower or the condenser, and the drying procedure is terminated by automatic partial opening of the door.

In the case of automatic partial opening of the door, the preceding method steps are so selected that the door of the dishwasher may be opened by the person using it without risk, in order that the residual moisture can escape into the kitchen space by natural convection. The temperature and moisture content are reduced so far that this residual moisture does not damage parts and apparatus, e.g. a work surface located above the dishwasher. The running time of the blower 16 in the dishwasher according to FIG. 1, i.e. the drying phase, comes to approximately 10 minutes. This also applies to a dishwasher with condenser 22 according to FIG. 2. After this drying phase, the hinged door is automatically opened to such a distance that the slot 60 at the top comes to approximately 10 mm.

If it desired to improve the drying effect, then after the cleaning and clear rinsing cycles there is introduced a draining time, i.e. a standstill phase of approximately 2 to 5 minutes before the drying phase. During this standstill phase residual water from the last clear rinsing phase can drain from the crockery, as it is still under reduced surface tension. This standstill phase is followed either by a drying phase with blower or condenser with the door closed, or in addition, after this drying phase, the door may be automatically partly opened. In this case the drying procedure includes two or three method steps.

Utilisation of the dishwasher requires no additional control measures.

Figure 3:
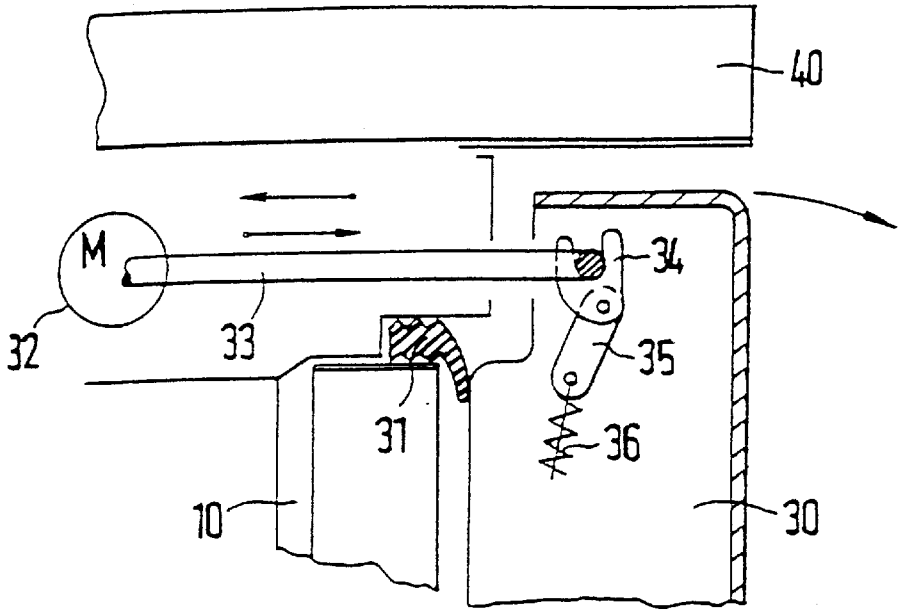
FIG. 3: a device for opening the hinged door to form a slot in a dishwasher, in the closed position.
Figure 4:
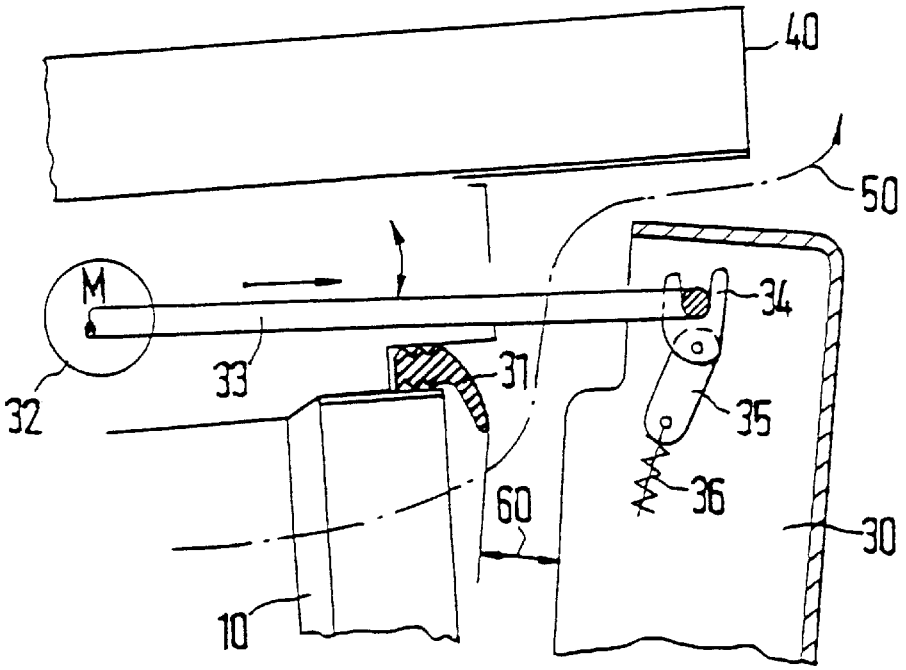
FIG. 4: the device according to FIG. 3 in the open position.

The periods of time provided for the standstill phase and the drying phase are predetermined by the control system of the dishwasher. A device for opening a hinged door 30 to form a slot is shown in the closed position in FIG. 3 and in the open position in FIG. 4 respectively. Located above the dishwasher is a work surface 40. The hinged door 30 encloses the forward side of the rinse container 10. A seal member 31 ensures sealing between the rinse container 10 and the hinged door 30. The reference numerals 34, 35 and 36 indicate a lock which is coupled with a closure bracket 33. The closure bracket 33 may be displaced by a motor 32 with reduction gear. Control of the motor 32 is effected automatically after the first drying phase, via the control system of the dishwasher. In this case the hinged door 30 is opened to such a distance that the slot 60 comes to approximately 10 mm, as FIG. 4 shows. The residual moisture 50 can then escape through the slot 60 from the rinse container 10.

Design of the coupling between the closure bracket 33 and the lock may in this case be such that the locking is retained. If the operator wishes to open the hinged door 30 totally, he must firstly bring the lock into the open position. The coupling may however be of such a type that the lock is also engaged with the automatic slot-like opening of the hinged door 30. In that case a counterbalance must hold the hinged door 30 in the slot-like open position. If the operator wishes to open the hinged door 30 totally, he then need only pivot it downwards.

Various constructive solutions for the automatic, slot-like opening of the hinged door 30 are possible. The only important feature is that this second drying phase is automatically initiated, and that the hinged door 30 is held in this open position by the lock itself or by the counterbalance.

We claim:

1. A method of drying crockery in a dishwasher with a rinse container closeable by means of a door, the method comprising:

cleaning and clear rinsing the crockery;

after the cleaning and clear rinsing cycles, with a predetermined time, moist air in the rinse container is replaced by dry fresh air, and thereafter the door is automatically opened to form a slot, and the remaining residual moisture escapes by natural convection.

2. A method for drying crockery in a dishwasher with a rinse container closeable by means of a door, cleaning and clear rinsing the crockery; after the cleaning and clear rinsing cycles, a predetermined drainage period is introduced, and, after the drainage period, for a predetermined period moist air is replaced in the rinse container by dry fresh air.

3. A method according to claim 1, wherein after the cleaning and clear rinsing cycles, a predetermined drainage period is introduced.

4. A method according to claim 3, wherein the moist air is evacuated from the rinse container by means of a blower.

5. A method according to claim 3, wherein water is precipitated from the moist air in a condenser, is passed into the rinse container and removed from the rinse container by means of an evacuating pump.

6. A method according to claim 1, wherein the slot has a selected size of approximately 10 mm.

7. A method according to claim 2 wherein the selected drainage time is between 2 and 5 minutes.

8. A method according to claim 1, wherein the moist air in the rinse container is replaced by dry fresh air for a period of approximately 10 minutes.

9. A device for carrying out the method according to claim 1, wherein in order to provide partial opening of the door there is provided a displaceably mounted closure bracket, which holds the door in the open position when it is opened with the lock engaged.

10. A device for carrying out the method according to claim 1, wherein there is provided for partial opening of the door a displaceable closure bracket which, upon opening, disengages the lock, and the door is held in the open position by means of a counterbalance device.

11. A device according to claim 9, wherein the times for the individual steps of the method are predetermined by the control system of the dishwasher.

12. A method according to claim 2, wherein the moist air in the rinse container is replaced by dry fresh air for a period of approximately 10 minutes.

13. A method of drying crockery in a dishwasher with a rinse container closeable by means of a door, the method comprising:

cleaning and clear rinsing the crockery;

after the cleaning and clear rinsing cycles, replacing moist air in the rinse container with forced dry fresh air for a predetermined time; and opening the door automatically to form a slot at the end of the predetermined time so that remaining residual moisture may escape by natural convection.

* * * * *